US005937139A

United States Patent [19]

Peterson

[11] Patent Number: 5,937,139

[45] Date of Patent: Aug. 10, 1999

[54] PORTABLE HOT-AIR BLOWER

[76] Inventor: Avo Peterson, Am Ziegelofen 29, D-40668 Meerbusch-Nierst, Germany

[21] Appl. No.: 08/875,489

[22] PCT Filed: Mar. 1, 1996

[86] PCT No.: PCT/EP96/00800

§ 371 Date: Jul. 24, 1997

§ 102(e) Date: Jul. 24, 1997

[87] PCT Pub. No.: WO96/28698

PCT Pub. Date: Sep. 19, 1996

[30] Foreign Application Priority Data

Mar. 9, 1995 [DE] Germany ..... 195 08 324

[51] Int. Cl.[6] ..... F24C 1/00

[52] U.S. Cl. ..... 392/307; 392/310

[58] Field of Search ..... 392/307, 310, 392/360–369, 373, 379–384; 432/94; 219/476–480

[56] References Cited

U.S. PATENT DOCUMENTS

| | | | |
|---|---|---|---|
| 1,998,427 | 4/1935 | Brown . | |
| 2,060,079 | 11/1936 | Hood . | |
| 3,164,715 | 1/1965 | Cotts | 392/307 |
| 4,141,408 | 2/1979 | Garnett | 392/307 |
| 4,417,131 | 11/1983 | Carl | 392/307 |
| 4,593,176 | 6/1986 | Seefeldt | 392/307 |

FOREIGN PATENT DOCUMENTS

| | | | |
|---|---|---|---|
| 10549 | 5/1980 | European Pat. Off. . | |
| 2610089 | 7/1988 | France | 392/307 |
| 2687899 | 9/1993 | France . | |
| 7419316 | 6/1974 | Germany . | |
| 3236242 | 4/1984 | Germany . | |
| 93 19 704 U | 4/1994 | Germany . | |
| 43 38 592 | 5/1994 | Germany . | |
| 410260 | 4/1947 | Italy | 392/307 |
| 55-63348 | 5/1980 | Japan . | |
| 5-34010 | 2/1993 | Japan . | |
| 5-322312 | 12/1993 | Japan . | |
| 7-318167 | 12/1995 | Japan . | |

OTHER PUBLICATIONS

"Gas/electric Dual Fuel Heater Durotherm" 1997.

*Primary Examiner*—Teresa Walberg
*Assistant Examiner*—Quang Van
*Attorney, Agent, or Firm*—Herbert Dubno; Andrew Wilford

[57] ABSTRACT

A portable hot-air blower for at least two of the three forms of energy including oil, liquid-petroleum-gas, and electricity has a tubular or tunnel-shaped housing defining a combustion chamber and a blower in the housing including a fan and a fan motor for directing a current of air along an axis through the chamber. At least two heat sources are axially spaced in the chamber in the housing from one another. One of the heat sources is powerable by electricity and the other of the heat sources by a respective one of the other two forms of energy, that is oil or gas. An ambient-temperature sensor is connected to a controller that serves, on detecting a very low ambient temperature, to first operate the electrically powered heat source until the blower is warm enough for safe operation of the other heat source, and then start the other heat source.

3 Claims, 1 Drawing Sheet

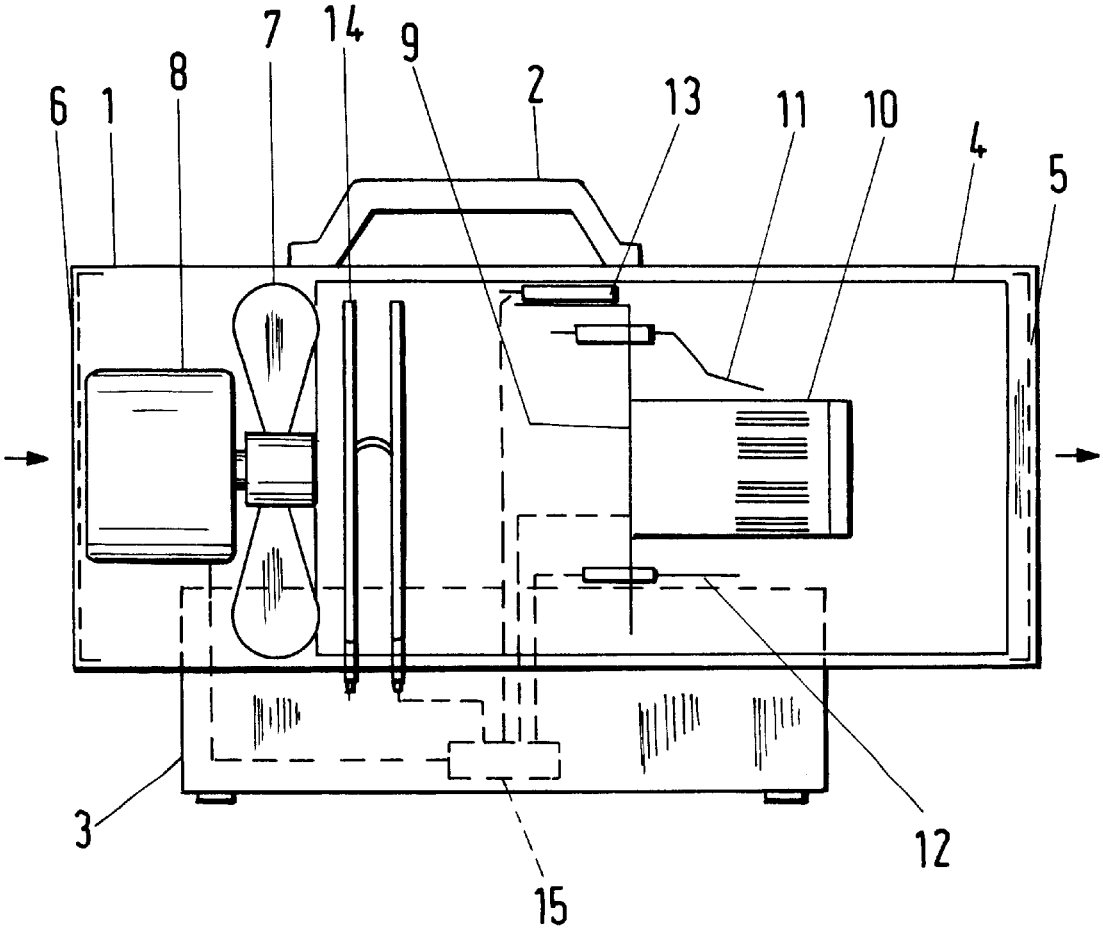
6
1
8
7
14
9
2
13
11
10
4
5
3
15
12

PORTABLE HOT-AIR BLOWER

CROSS REFERENCE TO RELATED APPLICATIONS

This application is the US national phase of PCT application PCT/EP96/00800 filed Mar. 1, 1996 with a claim to the priority of German application 195 08 324.5 itself filed Mar. 9, 1995.

FIELD OF THE INVENTION

The invention relates to a portable hot-air blower for at least two of the three forms of energy—oil (also diesel and fuel oil), liquid-petroleum gas, and electricity—with a tubular or tunnel-shaped housing.

Portable heaters of the described type have hitherto only been set up for one of the three forms of energy. In them the motor for driving the blower moving the air is always electrically powered. Such portable hot-air blowers are used generally in construction, in farming, for thawing, tempering, and for frost protection of pipes and equipment as well as emergency heaters. The main requirements of such a portable hot-air blower are the greatest possible mobility, the smallest size, and the lightest weight as well as the possibility of use in many applications.

Heaters for more than one form of energy are known for stationary use. Thus there are stoves, hot-air furnaces, cooking vessels, heaters, heat exchangers, and hot water heaters with devices for the alternate or simultaneous use of different forms of energy.

German published application 3,236,242 describes for example a fan-less space heater for solid fuel which is provided for augmenting the heat output with electrical heating elements that can be used alone during transitional times for space heating.

A retrofit electrical heater for water heaters using solid or liquid fuel is further known from German utility model 7,419,316.

A stationary ventilator-assisted heating element is furthermore known from German utility model 9,319,704 which is formed of a hot-water and night-current storage element and/or heatable ceramic plates.

The above-described known devices do not meet the requirements with respective to safety, venting, environmental concerns, size, and weight of the known portable hot-air blowers.

Portable hot-air blowers with low weight and which can easily be carried or moved are only known to date for one of the three energy forms. With them the motor for moving the required amount of air is always electrically powered. Such portable hot-air blowers are used in many applications, in agriculture, to thaw, warm, and prevent from freezing pipes and equipment and as emergency heaters. The requirements for such a hot-air blower are the greatest possible portability, the smallest size, and the smallest weight as well as many applications of use. These hot-air blowers have a tubular or tunnel-shaped construction.

Since the hot-air blowers of the known type are only set up for one form of energy they are burdened with energy-specific disadvantages. Thus oil-fired devices are the most effective with respect to energy costs; but their use for devices without heat-exchangers and venting is limited to well vented spaces. As a result of the mixing of the exhaust gases with the room air the known hot-air blowers are in particular not suitable for heating spaces in which men, animals, or plants remain.

The hot-air blowers fired with liquid-petroleum gas on the other hand are more expensive with respect to energy and require—like oil heaters—good venting of the space being heated. They increase humidity and cannot be used below ground. Nonetheless, men, animals, and plants can be exposed for long periods in rooms heated with liquid-petroleum gas.

Electrically powered hot-air blowers have no requirements with respect to venting; they are best suited for long-term exposure of men, animals, and plants. Since with electrically powered hot-air blowers no flame must be ignited they also start at very low temperatures and under any atmospheric conditions. Alone of the three groups of hot-air blowers the electrically powered hot-air blowers can be used with great operational safety over the long term since electricity is always available to produce heat energy so that shutdowns—as necessary for the periodically necessary refilling of oil heaters or for the exchange of gas bottles for gas heaters along with the associated requirements on service personnel—do not occur. As a result of there being no need to vent the space the energy requirements for a particular temperature level can be somewhat less than with the use of heaters with oil or gas; this is outweighed however slightly by the cost of electricity per kWh compared to oil and gas.

If one wants to take into account for example all the inside use or other commercial use with the changing applications of all use- and safety-relevant, humanitarian, and locally required safety considerations, the heater must not only meet the necessary spectrum of application but must also be able to switch between the three energy forms. This requirement can nowadays only be met when at least for parts of the application spectrum oil and also gas and further electrical systems are provided. The necessary capital investment results in a compromise not only with respect to the appropriateness of application but also with respect to safety and humanitarian requirements. Even when the appropriate devices are stocked by the business the devices are used in the field inappropriately as the appropriate device is not immediately available at the location. For example if a painter wants to heat an above-ground room of a residence with a liquid-petroleum gas heater, he or she then takes it down to the cellar where only an electrical heater is allowed.

OBJECT OF THE INVENTION

It is an object of the invention to reduce the volume, weight, and overall expense for the portable-heater inventory of a business, to use a heater according to requirements with the energy best suited for the application selected from two energy forms, to reduce energy costs by rapid and simple conversion to another form of energy, and to increase the service life—by automatic switching to the second or third energy form—while increasing safety.

SUMMARY OF THE INVENTION

This object is achieved in the described type of hot-air blower wherein the housing is tubular or tunnel-shaped, the energy converters are axially arranged in a common combustion chamber, a jointly used blower having at least a fan and a fan motor is provided.

According to the invention the energy converters are connected to a controller by means of which the energy converters, such as an oil burner, gas burner, and/or electrical heating element, are started or stopped. This starting can take place manually as well as automatically. As a result depending on nominal heat requirements more than one of the provided energy forms can be used simultaneously. In a hot-air blower provided with heating elements using electricity and liquid-petroleum gas it is possible for example by switching on the electrical heating element to increase the loading of the electrical system and thus the efficiency of the overall apparatus when during use of the hot-air blower with liquid-petroleum gas the auxiliary energy for the fan, the controller, and the ignition is taken not from line but from an electrical system operating at partial load.

In accordance with a further feature of the invention the controller is so constructed that in case of a disturbance in the selected mode of operation—for example failure of the gas or oil supply—it switches automatically over to the other form of energy or one of the other forms of energy. In the described hot-air blower with a gas-heater controller, the switch for a failure lamp can also serve for switching on the electrical heating element when the controller shuts off the gas system because of lack of fuel or failure to ignite. With a hot-air blower of the described type with a nominal heat capacity of for example 10 kW when powered by liquid-petroleum gas, the fan motor, solenoid valve, and other electrical parts are normally powered from line which has an electrical capacity of between 2 kW and 3.6 kW. The operation of the electrical heating element of this hot-air blower can thus be undertaken without setting up a new electrical supply in this range, which in most cases is sufficient for emergency operation, in particular to avoid freezing. With this operation the same apparatus can therefore work as a simple electrical heater, for example in garages, cellars, and other rooms below grade where oil and gas heaters should not be used.

A particularly advantageous embodiment of the object of the invention is that the controller is connected with the fan motor and on switchover of energy type changes the rotation rate of the fan motor for the air throughput appropriate to the respective mode of operation. In this manner for each mode of operation the optimal amount of air is used by selection of the appropriate rotation rate of the fan motor.

The hot-air blower according to the invention can also be improved in that the controller is constructed such that in case of a very low ambient temperature and/or disadvantageous weather conditions the selected mode of operation is started only when sufficient warmth has been produced by the electrical heat element for a safe ignition of the appropriate energy converter. This preheating can take place automatically, for example by means of a thermostat or by manual operation of a switch.

A further improvement of the hot-air blower according to the invention is achieved in that the necessary switching, controlling, monitoring, and safety elements—with the exception of the energy-specific elements—are connected with all of the provided energy converters. A hot-air blower constructed in this way necessitates only a modest extra production cost and can be made extremely compact. Thus with a hot-air blower using electricity and liquid-petroleum gas the only parts that are not already required for operation with liquid-petroleum gas are the electrical heater elements. In addition only the main switch need be replaced with a converting switch.

The advantages achieved with the invention consist mainly in the following points, taken together or separately:

Reduction of the investment in the heating-device inventory of a business by a fewer number of devices.

Reduction of the energy costs by simple changing of the form of energy, for example at the site, without switching the device.

Easy adaptation of the heater to the site requirements or other requirements.

More use of the individual device which can be employed in different situations.

Increase of safety by the greatly simplified possibility to switch to electrical operation without an open flame.

Increase of the operational readiness and safety by improving the ignitability when using oil or gas.

BRIEF DESCRIPTION OF THE DRAWING

The invention is more closely described with reference to the drawing in which by way of example a portable liquid-petroleum gas/electric hot-air blower is shown in a schematic longitudinal section.

SPECIFIC DESCRIPTION

The portable liquid-petroleum gas/electric hot-air blower shown in the drawing has a tubular housing 1 that is provided with a carrying handle 2 and with a bottom housing 3 formed as a control and connection box. The tubular housing 1 holds a combustion chamber 4 which is protected from contact by a front protective mesh 5 and a back protective mesh 6. Behind the combustion chamber 4 is a fan 7 which is driven by a fan motor 8 and which moves a controlled amount of air in the direction of the arrows through the housing 1. The combustion chamber 4 holds a burner plate 9 on which a gas burner 10 is provided. The gas burner 10 is ignited by an ignition electrode 11 when gas is released. The continuous burning of the flame is monitored by a flame detector 12 which can be constituted as a photoelement, photoresistor, thermoelement, or ionization electrode. In case of a disturbance the monitor 12 stops the gas feed. A safety thermostat 13 shuts off the gas feed in case of an excessive temperature increase with restricted air throughflow or a defect of the fan 7 or of its motor 8. Between the fan 7 and the gas burner 10 is an electrical heating element 4 that in the illustrated embodiment is formed as two planar wound tubular heating bodies. A controller 15 mounted in the bottom housing 3 is connected to the gas burner 10, the electrical heating element 14, the flame monitor 12, the safety thermostat 13, and the fan motor 8.

I claim:

1. A portable hot-air blower for at least two of the three forms of energy including oil, liquid-petroleum gas, and electricity, the blower comprising:

a tubular or tunnel-shaped housing defining a combustion chamber;

blower means in the housing including a fan and a fan motor for directing a current of air along an axis through the chamber;

at least two heat sources axially spaced in the chamber in the housing from one another, one of the heat sources being powerable by electricity and the other of the heat sources being powered by a respective one of the other two forms of energy;

an ambient-temperature sensor; and control means connected to the sensor for, on detecting a very low ambient temperature, first operating the electrically powered heat source until the blower is warm enough for safe operation of the other heat source and then operating the other heat source.

2. The portable hot-air blower defined in claim 1, further comprising sensor means for detecting a failure of operation of the heat sources; and control means connected to the heat sources and to the sensor means for, on detected failure of one of the heat sources, switching from the failed heat source to another of the heat sources.

3. The portable hot-air blower defined in claim 1, further comprising control means connected to the heat sources and to the fan motor for varying the rotation rate of the fan motor in accordance with which of the heat sources is being used.

* * * * *